US005092761A

United States Patent [19]

Dinicolantonio

[11] Patent Number: 5,092,761

[45] Date of Patent: Mar. 3, 1992

[54] FLUE GAS RECIRCULATION FOR $NO_x$ REDUCTION IN PREMIX BURNERS

[75] Inventor: Arthur R. Dinicolantonio, Seabrook, Tex.

[73] Assignee: Exxon Chemical Patents Inc., Linden, N.J.

[21] Appl. No.: 615,357

[22] Filed: Nov. 19, 1990

[51] Int. Cl.[5] ..... F23C 9/8

[52] U.S. Cl. ..... 431/115; 431/9; 110/265; 285/47; 285/223

[58] Field of Search ..... 431/115, 116, 9, 10, 431/12, 187, 188, 354; 110/204, 205, 265; 285/4, 187, 47, 53, 224, 229, 54, 223, 225

[56] References Cited

U.S. PATENT DOCUMENTS

| | | | |
|---|---|---|---|
| 2,813,578 | 11/1957 | Ferguson | 431/115 |
| 2,918,117 | 12/1959 | Griffin | 431/116 |
| 3,260,227 | 4/1966 | Daman et al. | 431/115 |
| 3,633,946 | 1/1972 | Kazmierski, Jr. | 285/229 |
| 4,004,875 | 1/1977 | Zink et al. | 431/9 |
| 4,230,445 | 10/1980 | Janssen | 431/116 |
| 4,575,332 | 3/1986 | Oppenberg et al. | 431/9 |
| 4,629,413 | 12/1986 | Michelson et al. | 431/9 |
| 4,659,305 | 4/1987 | Nelson et al. | 431/9 |
| 4,708,638 | 11/1987 | Brazier et al. | 431/116 |

FOREIGN PATENT DOCUMENTS

| | | | |
|---|---|---|---|
| 3048201 | 7/1982 | Fed. Rep. of Germany | 431/116 |
| 2629900 | 10/1989 | France | 431/115 |
| 0014224 | 2/1977 | Japan | 431/115 |
| 0023869 | 2/1980 | Japan | 431/116 |
| 0016108 | 1/1983 | Japan | 431/115 |

*Primary Examiner*—Ira S. Lazarus
*Assistant Examiner*—L. Heyman
*Attorney, Agent, or Firm*—Linda K. Russell

[57] ABSTRACT

A method and apparatus for reducing $NO_x$ emissions from premix burners by recirculating flue gas. Flue gas is drawn from the furnace through a pipe or pipes by the aspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The flue gas recirculating system may be retrofitted into existing premix burners or may be incorporated in new low $NO_x$ burners.

18 Claims, 5 Drawing Sheets

FLUE GAS RECIRCULATION FOR $NO_x$ REDUCTION IN PREMIX BURNERS

BACKGROUND OF THE INVENTION

1. Field Of The Invention

This invention is related to an apparatus and method for reducing $NO_x$ emissions from premix burners, without altering critical heat distribution from the burners. This invention may be employed in high temperature furnaces, for example, for steam cracking hydrocarbons.

2. Description Of Background And Relevant Information

Various nitrogen oxides, i.e., $NO_x$ compounds, are formed in air at high temperatures; these include, but are not limited to, nitric oxide and nitrogen dioxide. Reduction of $NO_x$ emissions is a desired goal in order to decrease air pollution and meet government regulations.

Burners may use either liquid fuel or gas. Liquid fuel burners may mix the fuel with steam prior to combustion to atomize the fuel to enable more complete combustion, and combustion air is mixed with the fuel at the point of combustion.

Gas fired burners are classified as either raw gas or premix, depending on the method used to combine the combustion air and fuel. These burners differ in configuration, and in the type of burner tip used.

Raw gas burners inject fuel directly into the combustion air stream, and the mixing of fuel and air occurs simultaneously with combustion.

Premix burners mix the fuel with some or all of the combustion air prior to combustion. Premixing is accomplished by using the energy of the fuel stream so that air flow is generally proportional to fuel flow. Therefore, frequent adjustment is not required and the achievement of desired flame characteristics is facilitated.

Floor-fired premix burners are used in many steam crackers and reformers, mainly for their ability to produce relatively uniform heat distribution in the tall radiant sections of these furnaces. Flames are non-luminous, permitting tube metal temperatures to be readily monitored. Due to these properties, premix burners are widely used in various steam cracking furnace configurations.

MICHELSON et al., U.S. Pat. No. 4,629,413, discloses a low $NO_x$ premix burner and discusses the advantages of premix burners and methods to reduce $NO_x$ emissions; this patent is incorporated herein in its entirety, by reference thereto. The premix burner of MICHELSON et al. lowers $NO_x$ emissions by delaying the mixing of secondary air with the flame and allowing some cooled flue gas to recirculate with the secondary air.

BRAZIER et al., U.S. Pat. No. 4,708,638, discloses a fluid fuel burner, in which $NO_x$ emissions are reduced by lowering the flame temperature. A venturi in a combustion air supply passage, upstream of a swirler, induces the flow of flue gas into the combustion air supply passage from ducts opening into the furnace. A swirler is located at the free end of a fuel pipe and mixes the flue gas with the primary combustion air.

FERGUSON, U.S. Pat. No. 2,813,578, discloses a heavy liquid fuel burner, which mixes the fuel with steam prior to combustion. The aspirating effect of the fuel and steam draws hot furnace gases into a duct and into the burner block to aid in heating the burner block and the fuel and steam passing through a bore in the block. This arrangement is disclosed as being effective to prevent coke deposits on the burner block and also to prevent any dripping of the oil. Since the flame temperature is raised, this arrangement would not aid in reducing $NO_x$ emissions.

JANSSEN, U.S. Pat. No. 4,230,445, discloses a fluid fuel burner, which reduces $NO_x$ emissions by supplying a flue gas/air mixture through several passages. Flue gas is drawn from the combustion chamber by a blower.

ZINK et al., U.S. Pat. No. 4,004,875, discloses a low $NO_x$ burner, in which combusted fuel and air is cooled and recirculated back into the combustion zone. The recirculated combusted fuel and air is formed in a zone with a deficiency of air.

OPPENBERG et al., U.S. Pat. No. 4,575,332 discloses a burner having both oil and gas burner lances, in which $NO_x$ emissions are reduced by discontinuously mixing combustion air into the oil or gas flame to decelerate combustion and lower the temperature of the flame.

GRIFFIN, U.S. Pat. No. 2,918,117, discloses a heavy liquid fuel burner, which includes a venturi to draw products of combustion into the primary air to heat the incoming air stream to therefore completely vaporize the fuel.

In addition to MICHELSON et al., the other patents discussed above are also incorporated herein in their entireties, by reference thereto.

SUMMARY OF THE INVENTION

An object of the present invention is to provide means for retrofitting an existing premix burner to lower $NO_x$ emissions, and thereby decrease air pollution and satisfy government standards. Retrofitting an existing premix burner utilizing the present invention is estimated to cost approximately $2,000 per burner. In comparison, replacing an existing premix burner with a new low $NO_x$ premix burner would cost approximately $8,000 to $10,000 per burner. Because a steam cracking furnace may have 50 burners, for example, retrofitting the furnace utilizing the present invention would therefore present considerable savings over replacing the burners of the furnace.

A premix burner for the combustion of fuel gas and air with reduced $NO_x$ emissions is located adjacent a first opening in a furnace, and includes a burner tube having a downstream end and an upstream end. A burner tip is mounted on the downstream end of the burner tube adjacent the first opening in the furnace, and combustion of the fuel gas and air takes place at the burner tip.

A gas spud is located adjacent the upstream end of the burner tube in a primary air chamber for introducing fuel gas into the burner tube. Air also is introduced into the upstream end of the burner tube. According to the present invention, at least one passageway has one end at a second opening in the furnace and a second end adjacent the upstream end of the burner tube.

Flue gas is drawn from the furnace, through the passageway, in response to fuel gas and air flowing towards the downstream end of the burner tube, whereby the flue gas is mixed with the air at the upstream end of the burner tube prior to the point of combustion of the fuel gas and air, to thereby reduce $NO_x$ emissions.

According to one aspect of the invention the flue gas is drawn from the furnace into the passageway in response to fuel gas flowing through a venturi portion in the burner tube. The passageway includes a duct extending into a second opening in the furnace at one end and into the primary air chamber at the other end. At least one adjustable damper opens into the primary air chamber from the ambient to restrict the amount of ambient air entering into the primary air chamber, thereby providing a vacuum to draw flue gas from the furnace.

According to another aspect of the invention, the passageway includes two ducts. Each duct may be substantially L-shaped, and further includes flexible seal means at one or both ends of the duct. The respective seal means are adapted to be connected to a portion of the furnace and to the duct.

The premix burner further includes at least one staged air port opening into the furnace. Ambient air passes into the furnace through the at least one staged air port, and is drawn into the at least one duct to lower the temperature of the gas flowing through the duct.

Another object of the invention is to provide a method of retrofitting an existing premix burner in a furnace to reduce $NO_x$ emissions, wherein the premix burner includes a burner tube having a downstream end and an upstream end, with a burner tip being mounted on the downstream end of the burner tube where combustion of fuel gas and air takes place. Fuel gas is introduced into the upstream end of the burner tube in a primary air chamber, so that air is mixed with the fuel gas in the primary air chamber prior to the point of combustion.

The method includes the following steps:

A passageway is installed between the furnace and the primary air chamber. Flue gas is drawn from the furnace through the passageway in response to fuel gas and air flowing towards the downstream end of the burner tube. Flue gas is mixed with the air in the primary air chamber, prior to the point of combustion, so that $NO_x$ emissions are reduced.

Either one or two pipes may be installed between the furnace and the primary air chamber. Flexible seals are attached to each of the end portions of the pipes, and to a portion of the furnace.

According to another aspect of the invention, the burner tube includes a venturi portion, and flue gas is drawn from the furnace by the aspirating effect of the fuel gas and air passing through the venturi portion. The amount of ambient air drawn into the primary air chamber may be adjustably restricted to provide the vacuum necessary to draw flue gas from the furnace.

According to another aspect of the invention, the pipes are installed by forming openings in the floor of the furnace and in a wall of the primary air chamber, and inserting one end of at least one pipe in the opening in the floor and the other end of the pipe in the opening in the wall. The pipe may then be wrapped with a ceramic fiber blanket.

Another object of the invention is to provide a method for reducing $NO_x$ emissions in a premix burner. The premix burner is located adjacent a first opening in a furnace, and the method includes the steps of: combining fuel gas and air in a primary air chamber; providing combustion of the fuel gas and air at a combustion point downstream of the step of combining the fuel gas and air; and drawing flue gas from the furnace in response to fuel gas and air flowing towards the combustion point, whereby the flue gas mixes with the air in the primary air chamber prior to the point of combustion to thereby reduce $NO_x$ emissions.

The drawing step may include passing the fuel gas and air through a venturi, whereby the aspirating effect of the fuel gas and air flowing through the venturi draws the flue gas from the furnace. Ambient air, which is at a lower temperature than the flue gas, passes into the furnace, and then the lower temperature air, as well as the flue gas, are both drawn to the primary air chamber from the furnace; as a result, the temperature of the drawn flue gas is lowered. The ambient air may be fresh air having an ambient temperature, although the temperature may be in the range between a temperature colder than the ambient temperature and a temperature slightly below the temperature of the flue gas in the furnace.

BRIEF DESCRIPTION OF THE DRAWINGS

The invention is further explained in the description which follows with reference to the drawings illustrating, by way of non-limiting examples, various embodiments of the invention wherein.

DETAILED DESCRIPTION OF THE PREFERRED EMBODIMENTS

Figure 1:
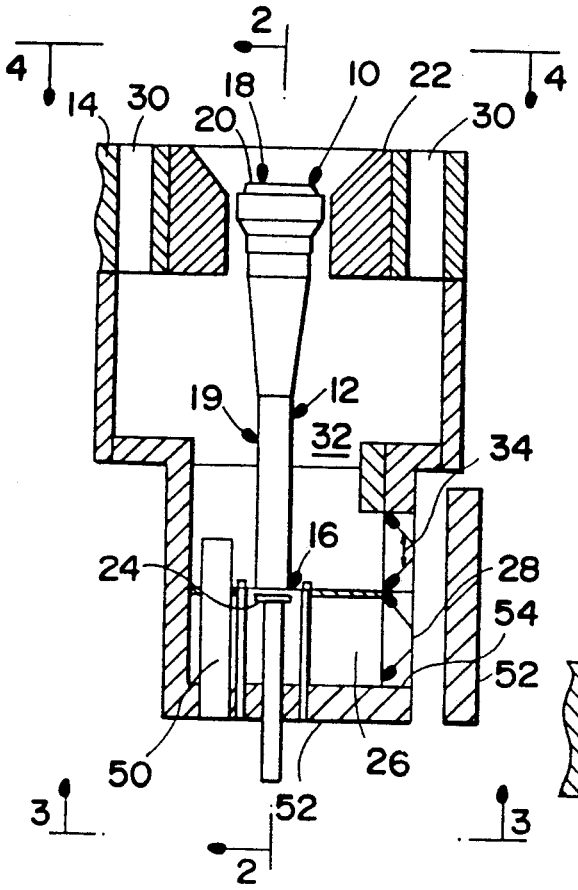
FIG. 1 illustrates an elevation partly in section of an embodiment of the premix burner of the present invention.
Figure 2:
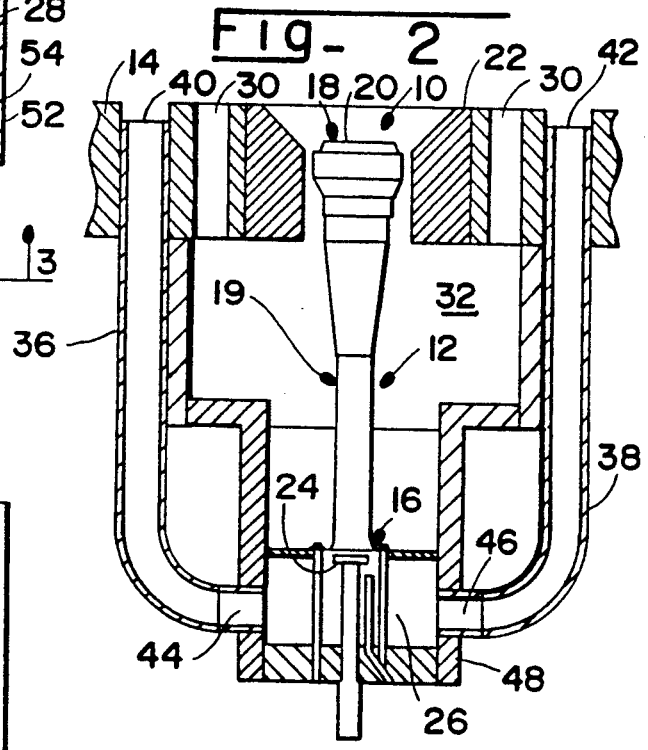
FIG. 2 is an elevation partly in section taken along line 2—2 of FIG. 1.
Figure 3:
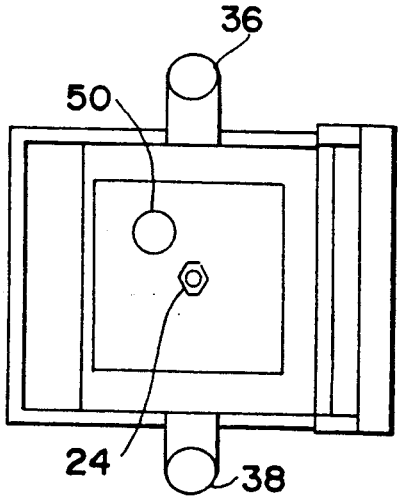
FIG. 3 is a plan view taken along line 3—3 of FIG. 1.
Figure 1A:
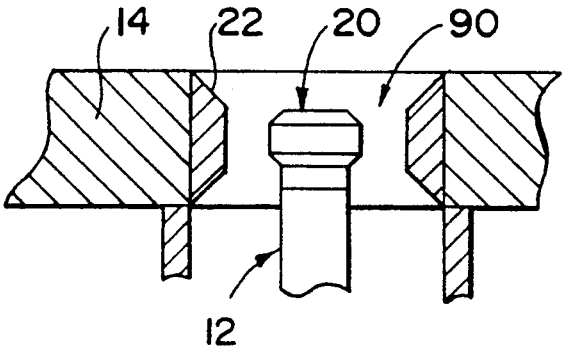
FIG. 1A is a partial elevation of a premix burner similar to FIG. 1, and includes a secondary air port instead of staged air ports.

Referring particularly to FIGS. 1–4, a premix burner 10 includes a freestanding burner tube 12 located in a well in a furnace floor 14. Burner tube 12 includes an upstream end 16, a downstream end 18 and a venturi portion 19. Burner tip 20 is located at downstream end 18 and is surrounded by an annular tile 22. Gas spud 24 is located at upstream end 16 and introduces fuel gas into burner tube 12. Fresh or ambient air is introduced into primary air chamber 26 through adjustable damper 28 to mix with the fuel gas at upstream end 16 of burner tube 12. Combustion of the fuel gas and fresh air occurs at burner tip 20.

A plurality of air ports 30 originate in secondary air chamber 32 and pass through furnace floor 14 into the furnace. Fresh air enters secondary air chamber 32 through adjustable dampers 34 and passes through staged air ports 30 or through secondary air port 90 into the furnace to provide secondary or staged combustion and to dilute the oxygen concentration of flue gas, as described in MICHELSON et al.

In order to recirculate flue gas from the furnace to the primary air chamber, ducts or pipes 36, 38 extend from openings 40, 42, respectively, in the floor of the furnace to openings 44, 46, respectively, in burner plenum 48. Flue gas containing, for example, 6–10% $O_2$ is drawn through pipes 36, 38 by the aspirating effect of fuel gas passing through venturi portion 19 of burner tube 12. In this manner, the primary air and flue gas are mixed in primary air chamber 26, which is prior to the point of combustion. Therefore, the oxygen concentration of the primary air is diluted prior to the point of combustion, thereby slowing down the combustion, and as a result, reducing $NO_x$ emissions. This is in contrast to a liquid fuel burner, such as that of FERGUSON et al., in which the combustion air is mixed with the fuel at the point of combustion, rather than prior to the point of combustion.

Closing damper 28 restricts the amount of fresh air that can be drawn into the primary air chamber and thereby provides the vacuum necessary to draw flue gas from the furnace floor.

Unmixed low temperature ambient air, having entered secondary air chamber 32 through dampers 34, and having passed through air ports 30 into the furnace, is also drawn through pipes 36, 38 into the primary air chamber by the aspirating effect of the fuel gas passing through venturi portion 19. The ambient air may be fresh air as discussed above. The mixing of the ambient air with the flue gas lowers the temperature of the hot flue gas flowing through pipes 36, 38 and thereby substantially increases the life of the pipes and allows use of this type burner to reduce $NO_x$ emission in high temperature cracking furnaces having flue gas temperature above 1900° F. in the radiant section of the furnace.

Advantageously, a mixture of approximately 50% flue gas and approximately 50% ambient air should be drawn through pipes 36, 38. The desired proportions of flue gas and ambient air may be achieved by proper placement and/or design of pipes 36, 38 in relation to air ports 30. That is, the geometry of the air ports, including but not limited to their distance from the burner tube, the number of air ports, and the size of the air ports, may be varied to obtain the desired percentages of flue gas and ambient air.

A sight and lighting port 50 is provided in the burner plenum 48, both to allow inspection of the interior of the burner assembly, and to provide access for lighting of the burner. The burner plenum may be covered with mineral wool soundproofing 52 and wire mesh screening 54 to provide insulation therefor.

Figure 5:
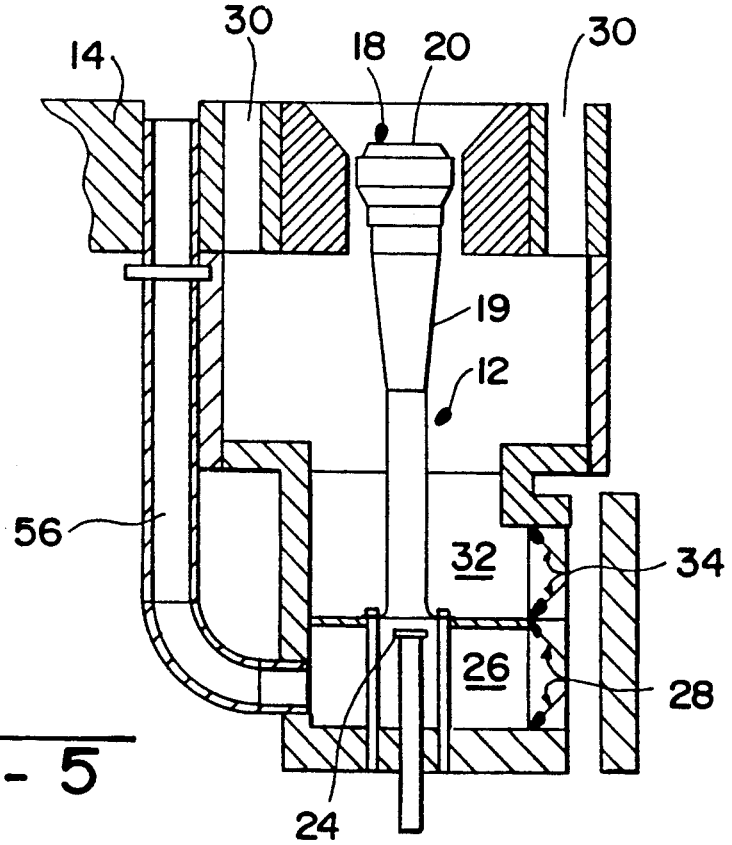
FIG. 5 is a second embodiment of the premix burner of the present invention.

An alternate embodiment of premix burner 10 is shown in FIG. 5, wherein like reference numbers indicate like parts. The main difference between the embodiment of FIGS. 1–4, and that of FIG. 5, is that the latter employs only one recirculation pipe 56. For example, one 6 inch diameter pipe may be used instead of two 4 inch pipes.

Figure 6:
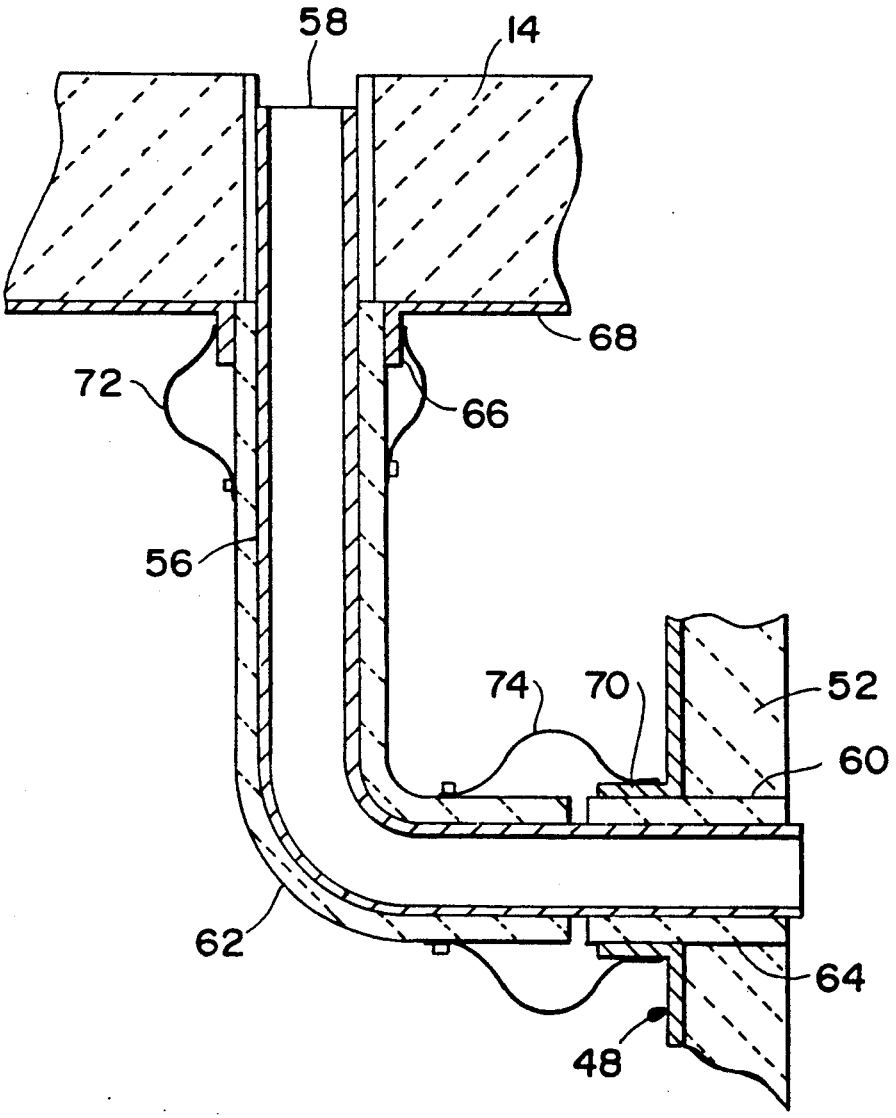
FIG. 6 is an elevation partly in section of the recirculation pipe of the present invention.

The recycle pipe 56 of FIG. 5, or the recycle pipes 36, 38 of FIGS. 1–4, may be retrofitted into an existing premix burner. Referring to FIG. 6, an opening 58 is formed in furnace floor 14, and an opening 60 is formed in a wall of burner plenum 48. Pipe 56 is then inserted, so that its respective ends extend into openings 58 and 60. Pipe 56 may be covered by insulation portions 62, 64, which may be ceramic fiber blankets.

Flange 66 is attached to furnace floor casing plate 68, and flange 70 is attached to burner plenum 48. Seal bag 72 is attached at one end to flange 66, and at the other end to insulation portion 62. Seal bag 74 is attached to flange 70 at one end, and to insulation portion 62 at the other end. The seal bags 72, 74 may be flexible and be made of any suitable heat-resistant material. Alternately, one or both seal bags may be eliminated and the recycle pipe may be seal welded to floor casing plate 68 or burner plenum 48.

Figure 9:
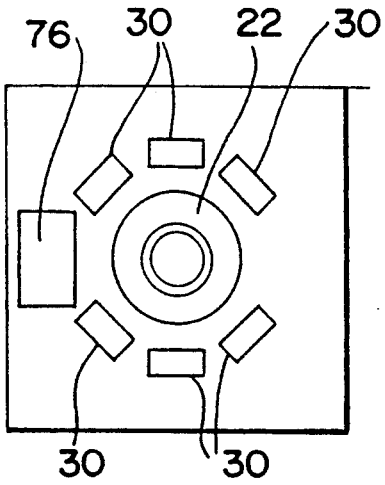
FIG. 9 is a plan view taken along line 9—9 of FIG. 7.
Figure 4:
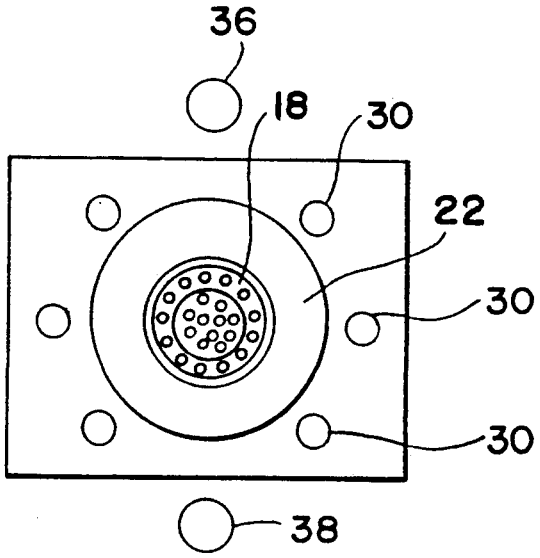
FIG. 4 is a plan view taken along line 4—4 of FIG. 1.
Figure 7:
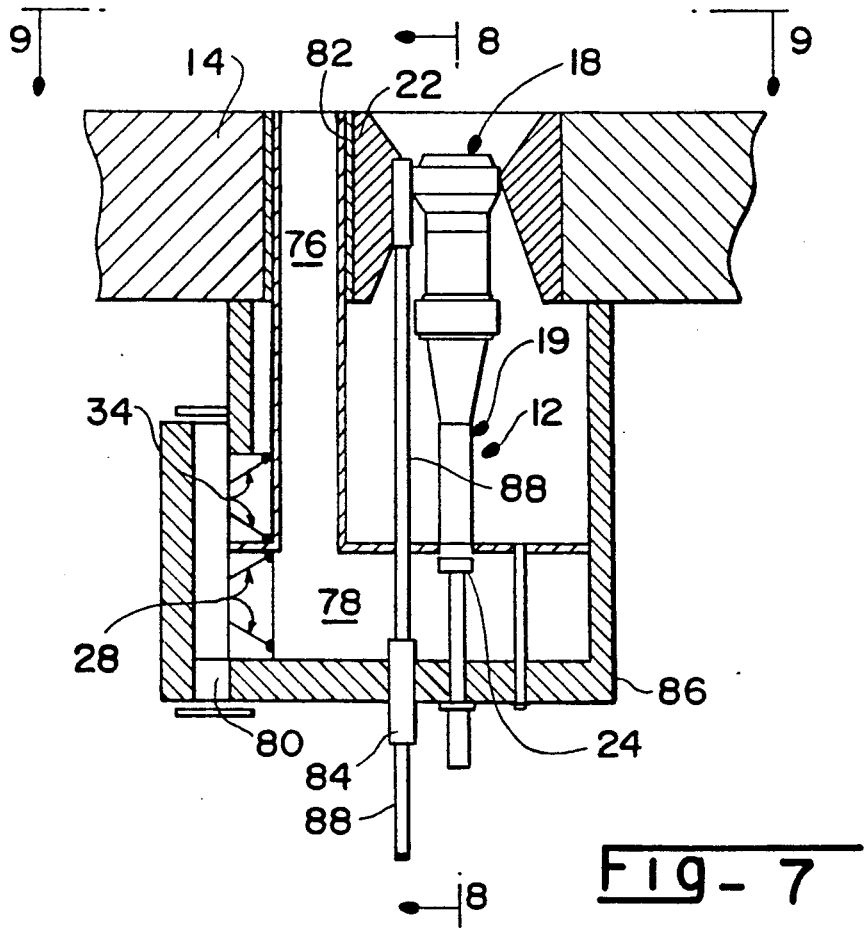
FIG. 7 is an elevation partly in section of a third embodiment of the premix burner of the present invention.
Figure 8:
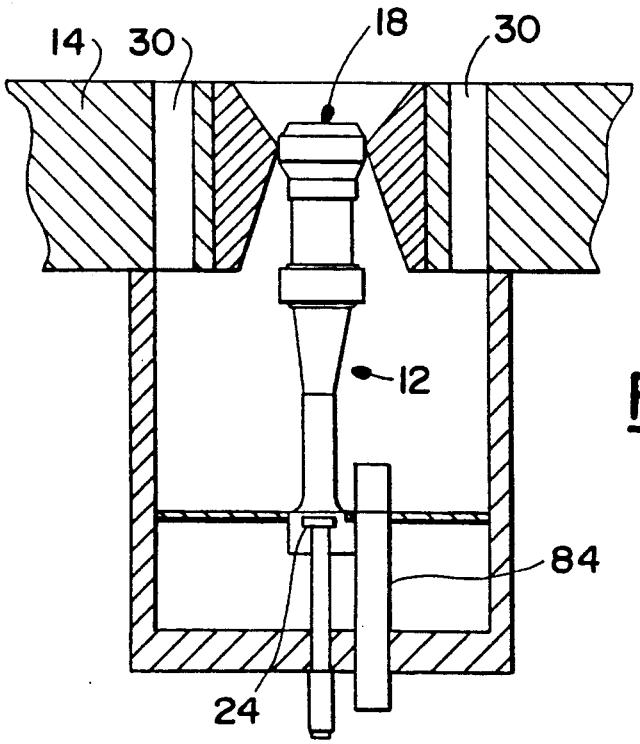
FIG. 8 is an elevation partly in section taken along line 8—8 of FIG. 7.

The flue gas recycling system of the present invention may also be applied to a new low $NO_x$ burner such as illustrated in FIGS. 7, 8 and 9, wherein like reference numbers indicate like parts. A flue gas recirculation passageway 76 is formed in furnace floor 14 and extends to primary air chamber 78, so that flue gas is mixed with fresh air drawn into the primary air chamber from opening 80. The external surface of passageway 76 may be wrapped with insulation 82, which may be a ceramic fiber blanket. Sight and lighting port 84 provides access to the interior of burner plenum 86 for pilot lighting element 88. It is noted that a similar pilot lighting element may also be used in the embodiments of FIGS. 1 and 5.

Premix burners, according to the present invention may be used under a wide range of operating conditions. An example is described below with reference to FIG. 5.

Fuel gas at 190 lbs./hr. is introduced into burner tube 12 from gas spud 24. Fresh air at 620 lbs./hr. and 60° F. flows through damper 28 into primary air chamber 26. Air at 2760 lbs./hr. and 60° F. flows through damper 34 into secondary air chamber 32 and passes through air ports 30 at 2,400 lbs./hr. and 60° F. As a result, fuel and flue gas are provided at 1,550 lbs./hr. and 2,100° F. at burner tip 20. The air ports 30 and pipe 56 are arranged such that flue gas at 380 lbs./hr. and 1,840° F. and air from air ports 30 at 360 lbs./hr. are drawn into pipe 56, to result in a flue gas and air mixture at 740 lbs./hr. which contains 9.4% $O_2$ and is at 1,025° F. in pipe 56.

As discussed above, the cooling of the flue gas by the fresh air increases the service life of the recycling pipe 56. The recycled flue gas dilutes the concentration of $O_2$ in the combustion air, which lowers the flame temperature, and thereby reduces $NO_x$ emissions.

Although the premix burners of this invention have been described in connection with floor-fired hydrocarbon cracking furnaces, they may also be used on the side walls of such furnaces or in furnaces for carrying out other reactions or functions.

Thus, it can be seen that, by use of this invention, $NO_x$ emissions may be reduced in a premix burner without the use of fans or special burners. The flue gas recirculation system of the invention can also easily be retrofitted to existing premix burners.

Although the invention has been described with reference to particular means, materials and embodiments, it is to be understood that the invention is not limited to the particulars disclosed and extends to all equivalents within the scope of the claims.

What is claimed is:

1. A premix burner for obtaining reduced $NO_x$ emission in the combustion of fuel gas, said premix burner being located adjacent a first opening in a furnace, said premix burner comprising:

(a) a burner tube having a downstream end, and having an upstream end for receiving air and fuel gas, a burner tip being mounted on the downstream end of said burner tube adjacent the first opening in the furnace, so that combustion of the fuel gas takes place at said burner tip;

(b) a gas spud located adjacent the upstream end of said burner tube, for introducing fuel gas into said burner tube;

(c) at least one passageway having a first end at a second opening in the furnace and a second end adjacent the upstream end of said burner tube;

(d) means for drawing flue gas from said furnace, through said passageway, in response to the aspirating effect of uncombusted fuel gas exiting the gas spud, said uncombusted fuel gas flowing through said burner tube from its upstream end towards its downstream end, whereby the flue gas is mixed with air at said upstream end of said burner tube prior to the point of combustion of the fuel gas and air; and (e) at least one air opening spaced from said at least one passageway and opening into the furnace, and arranged to allow uncombusted air, which is cooler than the flue gas, to be passed therethrough into said furnace, and thereafter to be drawn into said at least one passageway along with flue gas, to thereby lower the temperature of the drawn flue gas.

2. The premix burner according to clam 1, wherein said means for drawing flue gas from said furnace comprises a venturi portion in said burner tube.

3. The premix burner according to claim 1, comprising a primary air chamber, wherein said at least one passageway comprises a duct having a first end and a second end, said first end extending into a second opening in the furnace, and said second end extending into said primary air chamber.

4. The premix burner according to claim 2, comprising a primary air chamber, comprising at least one adjustable damper opening into said primary air chamber to restrict the amount of ambient air entering into said primary air chamber, and thereby to provide a vacuum to draw flue gas from the furnace.

5. The premix burner according to claim 3, wherein said at least one passageway comprises two of said ducts.

6. The premix burner according to claim 3, wherein said duct is substantially L-shaped.

7. The premix burner according to claim 3, further including flexible seal means at at least one of said first end and said second end of said duct.

8. The premix burner according to claim 7, wherein said seal means at said first end of said duct is for connection to a portion of the furnace and said duct, and wherein said seal means at said second end of said duct is connected to said duct and said primary air chamber.

9. A method of retrofitting an existing premix burner in a furnace to reduce $NO_x$ emissions, said premix burner including a burner tube and a gas spud, having a downstream end and an upstream end, a burner tip being mounted on the downstream end of said burner tube where combustion of fuel gas takes place, means for introducing fuel gas into the upstream end of said burner tube in a primary air chamber, so that air is mixed with the fuel gas in the primary air chamber prior to the point of combustion; said method comprising the steps of installing a passageway between the furnace and the primary air chamber for drawing flue gas from the furnace through the passageway in response to the aspirating effect of uncombusted fuel gas exiting from said gas spud and flowing towards the downstream end of said burner tube, and passing into the furnace, air having a temperature lower than the temperature of the flue gas, and then drawing said lower temperature air, along with said flue gas, to said primary air chamber, to thereby lower the temperature of the drawn flue gas.

10. The method of retrofitting an existing premix burner according to claim 9, wherein said step of installing said at least one passageway comprises installing at least one pipe between the furnace and the primary air chamber.

11. The method of retrofitting an existing premix burner according to claim 9, wherein said step of installing said at least one passageway comprises installing two pipes between the furnace and the primary air chamber.

12. The method of retrofitting an existing premix burner according to claim 10, further comprising attaching flexible sealing means to each end portion of said at least one pipe, and also attaching said sealing means to a portion of the furnace.

13. The method of retrofitting an existing premix burner according to claim 9, wherein said burner tube includes a venturi portion, wherein the drawing of flue gas from the furnace is caused by the aspirating effect of uncombusted fuel gas and air passing through said venturi portion.

14. The method of retrofitting an existing premix burner according to claim 13, in which said premix burner comprises means for adjustably restricting the amount of ambient air drawn into the primary air chamber to provide the vacuum necessary to draw flue gas from the furnace.

15. The method of retrofitting an existing premix burner according to claim 1, comprising forming openings in the floor of the furnace and in a wall of the primary air chamber, and inserting one end of said at least one pipe in the opening in said floor and the other end of said pipe in said wall.

16. The method of retrofitting an existing burner according to claim 10, comprising wrapping said at least one pipe with a ceramic fiber blanket.

17. A method for reducing $NO_x$ emissions in a premix burner, said premix burner being located adjacent a first opening in a furnace and including a gas spud, said method comprising the steps of: p1 (a) combining fuel gas and air at a predetermined location;

(b) combusting said fuel gas at a combustion point downstream of said predetermined location;

(c) drawing flue gas from the furnace in response to the aspirating effect of uncombusted fuel gas exiting said gas spud and flowing towards said combustion point, said flue gas mixing with said air at said predetermined location upstream of said point of combustion; and (d) passing into the furnace, air having a temperature lower than the temperature of the flue gas, and then drawing said lower temperature air, along with said flue gas, to said predetermined location, to thereby lower the temperature of the drawn flue gas.

18. The method for reducing $NO_x$ emissions according to claim 17, wherein said drawing step includes passing the fuel gas an air through a venturi, whereby the aspirating effect of the uncombusted fuel gas exiting a gas spud and flowing through said venturi draws the flue gas and lower temperature air from the furnace.

* * * * *